US012108783B2

(12) United States Patent
Fuhrmann et al.

(10) Patent No.: US 12,108,783 B2
(45) Date of Patent: Oct. 8, 2024

(54) ELONGATED SMOKING ARTICLE

(71) Applicant: REEMTSMA CIGARETTENFABRIKEN GMBH, Hamburg (DE)

(72) Inventors: Jan Fuhrmann, Hamburg (DE); Edward Cooper, Hamburg (DE)

(73) Assignee: REEMTSMA CIGARETTENFABRIKEN GMBH, Hamburg (DE)

( * ) Notice: Subject to any disclaimer, the term of this patent is extended or adjusted under 35 U.S.C. 154(b) by 588 days.

(21) Appl. No.: 17/297,436

(22) PCT Filed: Dec. 12, 2019

(86) PCT No.: PCT/EP2019/084781
§ 371 (c)(1),
(2) Date: May 26, 2021

(87) PCT Pub. No.: WO2020/126776
PCT Pub. Date: Jun. 25, 2020

(65) Prior Publication Data

US 2022/0007708 A1 Jan. 13, 2022

(30) Foreign Application Priority Data

Dec. 17, 2018 (EP) ..... 18212906

(51) Int. Cl.
*A24D 1/02* (2006.01)
*A24C 5/56* (2006.01)
*A24D 1/00* (2020.01)

(52) U.S. Cl.
CPC ..... *A24D 1/02* (2013.01); *A24C 5/56* (2013.01); *A24D 1/002* (2013.01)

(58) Field of Classification Search
CPC ..... A24D 1/002; A24D 1/02; A24C 5/56
(Continued)

(56) References Cited

U.S. PATENT DOCUMENTS 6,976,493 B2 12/2005 Chapman et al.
2010/0108081 A1* 5/2010 Blevins Joyce et al. ..... A24B 15/00 131/274
2017/0360086 A1 12/2017 Kaljura et al.

FOREIGN PATENT DOCUMENTS

CA 2438908 A1 9/2002
CN 108477672 A 9/2018
(Continued)

OTHER PUBLICATIONS

Russian Office Action (with English translation) for RU Application No. 2021111895/03(025527) dated Feb. 13, 2023, 15 pages.
Extended European Search Report for corresponding Application No. 18212906.4, dated Jul. 10, 2019, 7pp.
(Continued)

*Primary Examiner* — Christopher M Rodd
*Assistant Examiner* — Ronnie Kirby Jordan
(74) *Attorney, Agent, or Firm* — Lewis Roca Rothgerber Christie LLP

(57) ABSTRACT

The present invention relates to an elongated smoking article (100) (100) that extends in a longitudinal direction (L) and comprises a cylindrical smoking body (10) with a combustible material (11) that is surrounded by a wrapping paper (12). The smoking article (100) further comprises a filter element (20) that is configured to reduce substances from combustion gases drawn through the filter element (20) from the burning smoking body (10). A tipping paper (30) is circumscribing the smoking body (10) and the filter element (20) and is attached to external surfaces (13, 21) of the smoking body (10) and the filter element (20). According to the invention, a flavoring (80) is disposed in or on the tipping paper (30) with a distribution that varies in a circumferential direction (C) of the tipping paper (30), such that the amount and/or type of flavoring (80) contacting a smoker's lips (90)
(Continued)

depends on a rotational state of the elongated smoking article (100) with respect to the circumferential direction (C).

20 Claims, 4 Drawing Sheets

(58) Field of Classification Search
USPC ..... 131/365
See application file for complete search history.

(56) References Cited

FOREIGN PATENT DOCUMENTS

| | | | |
|---|---|---|---|
| EP | 2 219 481 | B1 | 9/2012 |
| RU | 2555651 | C2 | 7/2015 |
| RU | 2672304 | C1 | 11/2018 |
| WO | WO 2009/080604 | A1 | 7/2009 |
| WO | WO 2014/012841 | A2 | 1/2014 |
| WO | WO 2014/012841 | A3 | 1/2014 |
| WO | WO 2018/007626 | A1 | 1/2018 |
| WO | WO 2018/078316 | A1 | 5/2018 |

OTHER PUBLICATIONS

International Search Report and Written Opinion for corresponding International Application No. PCT/EP2019/084781, dated Mar. 26, 2020, 12pp.
European Office Action for EP Application No. 18212908.0 dated May 10, 2023, 4 pages.
European Search Report for EP Application No. 18212908.0 dated Jul. 10, 2019, 7 pages.
International Search Report and Written Opinion for International Application No. PCT/EP2019/084796 dated Apr. 3, 2020, 20 pages.
Office Action for U.S. Appl. No. 17/297,401 dated Mar. 6, 2024, 20 pages.
Russian Office Action for RU Application No. 2021111777/03(025199) dated Dec. 23, 2022, 7 pages.

* cited by examiner (A)

(B)

(A)

(B)

(A)

(B)

(C)

(A)

(B)

(C)

ELONGATED SMOKING ARTICLE

CROSS-REFERENCE TO RELATED APPLICATION(S)

This application is a National Phase Patent Application of International Patent Application Number PCT/EP2019/084781, filed on Dec. 12, 2019, which claims priority of European Patent Application No. 18212906.4, filed Dec. 17, 2018. The entire contents of both of which are incorporated herein by reference.

FIELD OF THE INVENTION

The present invention relates to an elongated smoking article comprising a smoking body filled with a combustible material and a filter element attached to the smoking body via at least one tipping paper. According to the present invention, a flavoring is disposed in or on the tipping paper with a circumferentially anisotropic distribution. The present invention further relates to a tipping paper for an elongated smoking article according to the invention.

BACKGROUND

Elongated smoking articles, such as e.g. (filter) cigarettes or cigarillos, are usually of cylindrical shape and comprise a smoking body that is filled with a combustible material. Therein, the combustible material comprises tobacco or a tobacco related product, such as e.g. shredded tobacco or reconstituted tobacco. For forming the smoking body, the combustible material is surrounded by a wrapping paper. Usually cigarettes have a cylindrical filter element that is aligned with the smoking body. The filter element is configured to filter substances, e.g. tar, from the combustion gases emitted by the burning combustible material and might comprises cellulose acetate, paper, and/or charcoal. Usually, the filter element is packed using a so-called plug wrap, e.g., a paper plug wrap. The filter element is usually attached to one end of the tobacco rod using a circumscribing wrapping material known as tipping paper. Therein, the tipping paper is overlaid with and attached to both, the filter element and the smoking body, as exemplarily shown in FIG. 1(*b*).

It is further known from the art to incorporate flavoring materials into smoking articles. Therein, the flavoring has been traditionally applied directly to the tobacco or to packaging materials (from where they migrate to the tobacco) in order to flavor the tobacco smoke that reaches the mouth of the smoker. It is further known from the prior art that this effect may be achieved by applying the flavoring to the wrapping paper or the filter element of an elongated smoking article. For delivering an improved gustatory experience directly to the mouth of a user it is further known to apply a flavoring material to a part of the filter end of a smoking article contacting a user's lips. However, it is common to the known solutions that a smoker is inevitably confronted with the flavoring materials, irrespective of whether or not the user wants to experience the additional flavoring. Further, a smoker cannot adjust the amount of additional flavoring to be added to the smoking experience and thus either extensive product lines had to be developed or only rather weak flavoring was applied to the smoking articles in order to comfort the majority of consumers.

It is thus an object of the present invention to overcome or reduce the disadvantages of the prior art and to provide an elongated smoking article that allows a smoker to adjust the intensity of an additional flavoring supplied to the smoker during the smoking experience.

SUMMARY OF INVENTION

One or more of the drawbacks of the prior art could be avoided or at least reduced by means of the present invention, particularly by an elongated smoking article that is extending in a longitudinal direction. Preferably, the elongated smoking article is one of a filter cigarette or a filter cigarillo and/or is rod-shaped with a cylindrical body. The elongated smoking article comprises a cylindrical smoking body that is configured to be burned during smoking of the smoking article. Therefore, the smoking body comprises combustible material that is surrounded by a wrapping paper. Therein, the wrapping paper forms a cylindrical surface around the combustible material, wherein the base areas of the smoking body are preferably uncovered by the wrapping paper. The elongated smoking article further comprises a filter element that is configured to reduce specific substances from combustion gases that are emitted from the burning smoking body, particularly the burning combustible material. The filter element is attached to one of the base areas of the smoking body in an end-to-end relationship and elongates the smoking body. Therefore, the filter element preferably is also of cylindrical shape with the same cross section as the smoking body. The filter element is further configured to draw combustion gases, i.e. smoke, from the burning smoking body. The filter element may comprise a filter plug, e.g., from cellulose acetate, that is wrapped in a so-called plug-wrap, which preferably is a paper plug wrap.

The elongated smoking article further comprises a tipping paper that is circumscribing the smoking body and the filter element. In other words, the tipping paper circumferentially encloses the cross sections of the smoking body and the filter element and extends in the longitudinal direction across the smoking body and the filter element. The tipping paper is further attached to the external surfaces of both, the smoking body and the filter element and thus connects the smoking body and the filter element. Preferably, the tipping paper is adhered to the external surfaces of the smoking body and the filter element.

According to the present invention, a flavoring is disposed in or on the tipping paper with a distribution that varies in a circumferential direction of the tipping paper. Therein, a flavoring is any substance that is capable of producing a gustatory sensation to a consumer, particularly when in contact with the lips of a consumer. Preferably, the flavoring is further capable of providing an olfactory sensation to the consumer (smoker, user), which might be independent of the contact with the consumer's lips. The circumferentially varying distribution refers to an amount of flavoring disposed in or on the filter element that varies, i.e. differs, along the circumferential direction. The circumferentially varying distribution may also refer to different flavorings disposed in or on the filter element along the circumferential direction.

The present invention thus provides an elongated smoking article with at least one flavoring disposed in or on the tipping paper of the filter element, wherein the amount of flavoring that is in contact with the lips of a smoker during smoking of the smoking article depends on a rotational state of the elongated smoking article, particularly with respect to the circumferential direction as referred to above. Therein, the rotation occurs preferably around a rotational symmetry axis of the filter element. Additionally or alternatively, the type of flavoring in contact with the lips of a smoker during smoking depends on a rotational state of the elongated smoking article, particularly with respect to the circumferential direction. Thus, the elongated smoking article of the present invention allows a consumer to individually adjust the amount and/or type of the flavoring that is experienced during smoking. Hence, a producer can comfort a vast majority of consumer's personal taste with a single product.

In a particularly preferred embodiment, the filter element has a circular cross section and the tipping paper has a circular ring cross section. In other words, the elongated smoking article forms a circular cylinder, wherein the smoking body and the filter element are of cylindrical shape as well and wherein the tipping paper is disposed on the cylindrical surface of the filter element. Therein, the tipping paper may fully or partially cover the cylindrical surface of the filter element. Further, the tipping paper may partially cover the free base area of the filter element that is intended to be inserted into a smoker's mouth.

According to this preferred embodiment, the flavoring is disposed within a first section of the tipping paper, wherein the first section is disposed on a first circle sector of the filter element, particularly on a circle sector of the cross section of the filter element. As the tipping paper extends along the filter element in a longitudinal direction, the first section is disposed on a plurality of first circle sectors of multiple cross sections of the filter element, these circle sectors being aligned in the longitudinal direction. Herein a circle sector refers to a portion of a disk that is enclosed by two radii and an arc, where the two radii enclose the central angle. Preferably, the central angle of the first circle sector is less than 180° and particularly preferred less than 90°. In other words, in a cross section the first section is a first circumferential section of the tipping paper, i.e. a section of the circular ring cross section of the tipping paper. Thus, in this embodiment, the consumer can decide on whether or not the first section touches his upper or lower lip by rotating the elongated smoking article. Particularly by aligning the first section with a vertical direction, he or she can bring it into full contact with his or her upper or lower lip. By aligning the first section with a horizontal direction, the user can reduce the contact of the first section and his or her upper or lower lip. Therein, the degree of contact naturally depends on the central angle of the first circle sector.

Further preferred, flavoring is further disposed within a second section of the tipping paper, wherein the second section is opposite to the first section. In other words, the second section is disposed on a second circle sector of the filter element, particularly on a second circle sector of the cross section of the filter element. Also the second section is actually disposed on a plurality of second circle sectors of multiple cross sections of the filter element, with these second circle sectors being aligned in the longitudinal direction. Preferably, the central angle of the second circle sector is less than 180° and particularly preferred less than 90°. In other words, in a cross section, the second section is a second circumferential section of the tipping paper, i.e. a section of the circular ring cross section of the tipping paper.

Particularly preferred, the second section is disposed on a second circle sector of the filter element that is opposite to the first circle sector. Thus, by aligning the first section with the vertical direction also the second section is aligned with the vertical direction and each section is in contact with a respective one of the consumer's lips. Further, by aligning the first section with the horizontal direction also the second section is aligned with the horizontal direction and each section is out of contact with a respective one of the consumer's lips. Thus, the degree of flavoring selectively experienced by a user can be maximized. Further preferred and in geometrical terms, the second section is a point reflection of the first section with respect to a rotational symmetry axis of the filter element, particularly in a cross section of the elongated smoking article. In other words, the central angle of the first circle sector equals the central angle of the second circle sector that is opposite to the first circle sector. Preferably, the central angle of the second circle sector is 180 degrees or less, particularly preferred the central angle of the second circle sector is 90 degrees or less.

In an alternative embodiment, a first flavoring is disposed in the first section and the second section of the tipping paper and a second flavoring, which is preferably different from the first flavoring, is disposed within a third section and a fourth section of the tipping paper. Also the third and fourth sections are disposed on a third and fourth circle sector of the filter element, respectively, particularly on third and fourth circle sectors of the cross section of the filter element. Also the third and fourth sections are actually disposed on a plurality of third and fourth circle sectors of multiple cross sections of the filter element, respectively. Therein the third and fourth circle sectors are aligned in the longitudinal direction, respectively. Preferably, the central angle of the third and fourth circle sector is less than 180° and particularly preferred less than 90°. According to this embodiment, the third section is preferably disposed between the first section and the second section and the fourth section is preferably opposite the third section. Hence, by aligning the first and second section with the vertical direction a user can experience the first flavoring and by aligning the third and fourth section with the vertical direction a user can experience the second flavoring. The first flavoring and the second flavoring may differ in intensity and/or type of flavoring, such that the consumer can influence his smoking experience by rotating the smoking article.

However, the first flavoring may also be equal to the second flavoring.

According to an alternatively preferred embodiment, a first flavoring is disposed within the first section of the tipping paper as described above and a second flavoring is disposed within a second section of the tipping paper as described above, wherein the second section is rotated from the first section about an angle of less than 180 degrees. This embodiment can thus provide the same effect as the previously described embodiment with only one section per flavoring. Particularly preferred, the first and second section are of the same size, i.e. have similar or identical central angels. Further preferred, the second section is rotated from the first section about an angle of 90° and the central angle of the first and second section is 90 degrees or less. Therein, the first and second sections are rotated in a rotation about the rotational symmetry axis of filter element and/or the smoking article. In other words, the first and second sections are spaced apart in the circumferential direction thereof.

In a particularly preferred embodiment, the remaining tipping paper, i.e. the tipping paper outside the sections as described above, does not comprise any flavoring. Thus, the user may further adjust the smoking experience by rotating the smoking article such that none of the sections is in contact with the consumer's lips and thus no gustatory sensation is experienced except that provided by the combustion gases of the smoking body. In other words, the above descriptions referring to sections of the tipping paper in or on which flavoring is disposed may refer to an exclusive application of flavoring to these sections. By applying such exclusively filled sections, the above described advantages are provided.

In an alternatively preferred embodiment, the concentration of flavoring changes continuously along the circumferential direction of the tipping paper. Also which such an embodiment, a flavoring can be disposed in or on the tipping paper with a distribution that varies in a circumferential direction of the tipping paper, wherein the circumferentially varying distribution refers to an amount and/or type of flavoring disposed in or on the filter element that varies, i.e. differs, along the circumferential direction. In other words, the concentration of at least one or a plurality flavoring changes continuously along the circumferential direction of the tipping paper. In this embodiment, different sections of the tipping paper as described above may also be provided, wherein the boundaries of these sections are no hard boundaries. Exemplarily, the embodiment with a first flavoring in a first section and a second opposite section and a second flavoring in a third section and a fourth opposite section may also be provided with concentrations of the two flavorings that change continuously along the circumferential direction. Further exemplarily, the embodiment with solely a first section with a flavoring or a pair of opposite first and second section with a flavoring may also be realized with a concentration of flavoring changing continuously along the circumferential direction of the tipping paper. A flavoring concentration may be non-zero across the full circumference of the tipping paper, but be high enough for a gustatory sensation only in the named sections.

Further preferred, the sections of the tipping paper comprising the flavoring as described above might extends across the whole length of the tipping paper in the longitudinal direction. Particularly, at least one of the first to fourth sections as described above may extend across the whole length of the tipping paper in the longitudinal direction of the elongated smoking article. In other words, an amount and/or type of flavoring that is contacting a smoker's lips does not depend on a translational state of the elongated smoking article with respect to the longitudinal direction thereof. Hence, the concentration and/or type of flavoring experienced by a consumer do not depend on such translational state.

However, according to an alternatively preferred embodiment, the distribution of the flavoring does further vary in a longitudinal direction of the tipping paper. In other words, the amount and/or type of flavoring that is contacting a smoker's lips does further depend on translational state of the elongated smoking article with respect to the longitudinal direction. Thus, the concentration and/or type of flavoring experienced by a consumer does depend on such translational state. In a most simple embodiment, the sections as described above may not extend across the whole length of the filter element in the longitudinal direction of the filter element but the flavoring may be disposed only in one or more cylindrical surface segments.

According to this preferred embodiment, the longitudinally varying distribution refers to an amount of flavoring disposed in or on the filter element that varies, i.e. differs, along the longitudinal direction. The longitudinally varying distribution may also refer to different flavorings disposed in or on the filter element along the longitudinal direction. In a particularly preferred embodiment, the elongated smoking article has a cylindrical shape, wherein the smoking body and the filter element are of cylindrical shape as well, the tipping paper is disposed on the cylindrical surface of the filter element and the flavoring is disposed within a first cylindrical section of the tipping paper. Therein, the first cylindrical section is a cylindrical surface segment of the filter element that is confined by a first circular (or elliptical) ring circumscribing the filter element and a second circular (or elliptical) ring circumscribing the filter element, wherein the second circular ring is spaced apart from the first circular ring along the longitudinal direction of the filter element and the elongated smoking article. Further preferred, the flavoring is also disposed in at least one second cylindrical section of the tipping paper, wherein the second section is spaced apart from the first section in the longitudinal direction and the second section is confined by a third and fourth circular ring circumscribing the filter element. Therein, the third and fourth circular ring are spaced apart from each other and from the first and second circular ring along the longitudinal direction. According to a further preferred embodiment, the flavoring is disposed within a plurality of cylindrical surface segments of the tipping paper, as described above. Therein, each of the cylindrical surface segments is enclosed by two circular or elliptical rings circumscribing the filter element as described above with respect to the first and second section.

According to these preferred embodiments, the cylindrical sections are spaced apart from each other in the longitudinal direction. Hence, by disposing different types or concentrations of flavoring in the individual cylindrical sections, a user can vary the type and/or the intensity of experienced flavoring by shifting the elongated smoking article along the longitudinal direction. Further preferred, the width of the cylindrical sections varies along the longitudinal direction. Exemplarily, the width of a cylindrical section may increase or decrease with increasing distance to the mouthpiece end of the filter element. Additionally or alternatively to varying the width of the cylindrical sections, the spacing between the cylindrical sections varies along the longitudinal direction. Exemplarily, the distance between cylindrical sections may increase or decrease with increasing distance to the mouthpiece end of the filter element. Also preferred, the concentration of flavoring differs in different cylindrical sections. Therein, a flavoring of identical or similar type can be disposed in or on different cylindrical sections with different concentrations. Exemplarily, the concentration of a flavoring in a cylindrical section may increase or decrease with increasing distance of the cylindrical section to the mouthpiece end of the filter element. Additionally or alternatively, different flavorings may be disposed within different cylindrical sections. Therein, the types of flavoring may differ between each of the cylindrical sections or between groups of cylindrical sections.

Thus, in these embodiments the consumer can decide on whether or not one or more of the cylindrical sections touches his upper and/or lower lip by translating the elongated smoking article along the longitudinal direction. Particularly by aligning a cylindrical section with the lips, the user can bring it into full contact with his or her upper and/or lower lip. By shifting the cylindrical section inside or outside of his or her mouth, the user can reduce the contact of the cylindrical section and his or her lips.

These preferred embodiments of the invention thus provide an elongated smoking article with at least one flavoring disposed in or on the tipping paper of the filter element, wherein the amount of flavoring that is in contact with the lips of a smoker during smoking of the smoking article depends on a rotational state and a translational state of the elongated smoking article. Therein, the rotational state is preferably defined with respect to the circumferential direction as referred to above and the translational state is preferably defined with respect to the longitudinal direction as referred to above. Therein, the rotation occurs preferably around a rotational symmetry axis of the filter element and/or the translation occurs along a length axis of the filter element. Additionally or alternatively, the type of flavoring in contact with the lips of a smoker during smoking depends on the rotational state and the longitudinal state of the elongated smoking article. Thus, the elongated smoking article of the present invention allows a consumer to individually adjust the amount and/or type of the flavoring that is experienced during smoking by moving the smoking article in two dimensions. Hence, a producer can comfort an even larger majority of consumer's personal taste with one product.

In a preferred embodiment, the flavoring that is disposed in and/or on the tipping paper is applied in form of a solution of the flavoring to the tipping paper. More general, the flavoring is applied as an at least initially not solid substance to the tipping paper. Preferably, the flavoring is printed to the tipping paper. Thus, the flavoring may include or be included in a variety of substrates for application to the tipping material such as, for example, inks, films, or other compositions that may include one or more pigments, fillers, and/or optical brightening agents. In a preferred embodiment, the flavoring composition is formulated to be printed on one or both sides of tipping material before, during, or after assembly of a smoking article such as a cigarette. However, the formulation may also be applied by other means including, for example, misting, spraying, or soaking the tipping material. One or more flavoring compositions may be incorporated into tipping material during its manufacture.

At least one layer of flavoring and possibly several layers of one or more flavorings is applied to a wrapping paper, preferably using a printing process. Most preferably, the flavoring is applied using gravure coating techniques, such as e.g. rotogravure printing techniques. Other preferred techniques for the applying the flavoring to the wrapping material include blade coating, air-knife coating, roll-coating and shaft coating techniques. Alternatively and/or additionally, the flavoring can be applied by spraying, ink jet coating, or other similar printing techniques. A printed wrapping paper can thus be provided with a distribution of at least one flavoring according to the invention. Gravure printing techniques involve printing from the continuous surface of a metal cylinder engraved mechanically or etched chemically so as to possess minute grooves or cells below the surface of that cylinder. A typical printing cylinder surface is provided by etching a smooth, polished copper surface and plating that etched surface with chrome. Those recessed cells or grooves hold liquid (or liquid dispersion) formulations form impressions, layers or "bumps" to be deposited onto the desired location of a substrate, such as a continuous web of paper wrapping material. Other printing techniques may be used as well, including flexographic, ink-jet, thermal-transfer (including laser), screen printing, or any other method for transferring a flavoring composition to a paper or paper-like material such as tipping paper.

Different solvents may be selected to carry the flavoring during application. Most solvents preferably will evaporate and/or will not have a negative impact upon the flavoring (including a smoker's experience thereof). Preferably, the solvent will not disrupt or damage the structure of the plug wrap, the wrapping paper or the tipping paper (e.g., by weakening it) or negatively affecting its appearance, nor will it confer any undesirable flavor.

Additionally or alternatively to the printing-type and other applications described herein, at least one flavoring might be applied with an adhesive to the tipping material. Some examples of flavorings that may be printed or otherwise applied to the tipping material or in the adhesive include methyl cyclopentenolone, vanillin, ethyl vanillin, and inulin and aromatic oils. Other flavorings (including flavor and aroma precursors) include, for example, vanillin glucoside and/or ethyl vanillin glucoside. Other flavorings may include, for example, ethyl vanillin, caryophyllene oxide, sugars (e.g., rhamnose), and different flavor precursors that will produce a flavor and/or aroma when contacted by the lips or tongue of a smoker and/or heat and/or moisture from mainstream aerosol. Inks that are useful as flavorings provide a scent, aroma, or other olfactory sensation.

The flavorings may be incorporated by means other than printing to one or both surfaces of the tipping paper. For example, the tipping paper may be dipped into a flavoring material such that it will be absorbed thereby and/or will adsorb to surfaces of material making up the tipping paper. As another example, microcapsules configured to release flavoring(s) may be incorporated into the tipping paper, for example, upon contact with moisture and/or warmth of a smoker's lips. Examples of such capsules may comprise synthetic capsules and/or biologically-derived "capsules", such as e.g., yeast organisms as a delivery means.

Flavoring includes any material that may be applied to the tipping paper and that provides one or more of a selected organoleptic sensation, a sensation of one or more tastes/flavors and/or scents/aromas that may be transmitted orally and/or olfactory, trigeminal nerve stimulation sensation, and may include a cool, warm, spicy, tangy, salty, tingly, bitter, sour, hot, sweet, or tart sensation for a smoker, or any combination of any of these sensations. Flavorings may be encapsulated or added directly. They may be printed together with, under, or on top of the inks that are commonly applied to tipping materials to provide a particular appearance (e.g., appearance of cork, lettering and/or logos, visible patterns, etc.). Flavorings may also be applied with lip-release (in the cigarette art, the term "lip-release" refers to materials configured to promote easy release of contact between human lips and the tipping-material-covered filter section of a cigarette without substantial sticking, and the lip-release material referred to herein may include any standard lip-release formulations currently known and/or practiced in the art, or developed in the future). A flavoring will provide a smoker with at least one oral and/or olfactory sense beyond a tactile contact with and other normal sensation associated with a tipping material lacking a flavoring.

In the context of this application, the flavoring may impart flavor directly to a smoker's lips and/or tongue via contact with the tipping paper. Alternatively or additionally, flavor may be provided from the flavoring by releasing an odor—whether passively, upon contact with a smoker, or upon being heated by passage of, for example, combustion gases of the burning smoking body. Release of flavor-affecting material (whether by or to the mouth and/or nose of the smoker) can be activated or intensified by heating the flavoring when a smoker draws the combustion gases through the filter such that these gases are proximate the flavoring. Moisture may also serve as a releasing means for flavor (e.g., from contact with a smoker's lips and/or tongue).

Some preferred flavorings will exhibit sensory characteristics that can be described as having notes that are sweet, woody, fruity, or some combination thereof. The flavorings are preferably employed in amounts that depend upon their individual detection thresholds. Combinations of flavorings may be used to provide one or more desired sensory characteristics to the experience of a smoker from the smoking articles incorporating those flavorings. Above that, some flavorings will provide a unique sensation to a smoker that may include, but go beyond one or more of taste, smell, and tactile sensation. For example, such flavorings may include menthol, menthanes, menthones, sweet proteins (e.g., thaumatin, monellin), essential oils containing menthol or menthol-like compounds (e.g., peppermint), other essential oils (wintergreen, spearmint), succinate esters, capsaicin, cinnamon, or any commercially-available (or future-developed) "cooling compounds" or "spicy compounds".

Preferred flavorings may be incorporated into printing formulations, will have low vapor pressures, will not have a tendency to migrate or evaporate under normal ambient conditions, and will be stable under the processing conditions experienced by tipping papers according to the present invention. Exemplary flavorings that provide sweet notes include ethyl vanillin, vanillin, inulin (a fructose oligomer).

According to an alternatively preferred embodiment, the flavoring is disposed on the tipping paper by applying at least one layer of flavoring material on the tipping paper. In other words, in this embodiment the filter element and the smoking body are circumscribed by a first tipping paper that is attached to the external surfaces of the smoking body and the filter element and then at least one additional layer of flavoring material, e.g. a band or stripe of a second tipping paper, is attached to the external surface of the first tipping paper. Therein, the flavoring material may comprise the flavoring with a constant concentration and the varying concentration around the circumferential direction of the filter element is achieved by applying a varying amount of the flavoring material along the circumferential direction. Alternatively, the flavoring material may comprise the flavoring with varying directions, wherein a gradient of these varying concentrations is aligned with the circumferential direction of the filter element. This embodiment advantageously allows applying the present invention belatedly to standard elongated smoking articles. Further, in this embodiment, a consumer can advantageously feel the flavoring material as elevation with his lips.

Additionally or alternatively, and isolated (detached) from this specific embodiment, the sections comprising the flavoring, or more generally the concentration of flavoring, may be indicated by coloring the tipping paper in order to provide guidance to a consumer.

Another aspect of the present invention is directed to a tipping paper for an elongated smoking article according to the invention as described above. Therein, the tipping paper is configured to circumscribe a smoking body and a filter element as described above and is configured to be attached to the external surfaces of a smoking body and a filter element as described above. Further, a flavoring is disposed in or on the tipping paper according to the invention with a distribution that varies in a direction of the tipping paper that is to become the circumferential direction of the tipping paper once it is circumscribing the filter element, particularly a cylindrical filter element of an elongated smoking article extending in a longitudinal direction. Further preferred, the distribution of the flavoring also varies in a direction of the tipping paper that is to become the longitudinal direction of the tipping paper once it is attached to the filter element. The preferred embodiments described above with respect to the elongated smoking article do also apply to the tipping paper of the invention.

BRIEF DESCRIPTION OF DRAWINGS

Further features of the invention will become apparent to those of ordinary skill in the art by describing in detail exemplary embodiments with reference to the attached drawings in which.

DETAILED DESCRIPTION OF AN EXAMPLE EMBODIMENT

Figure 1:
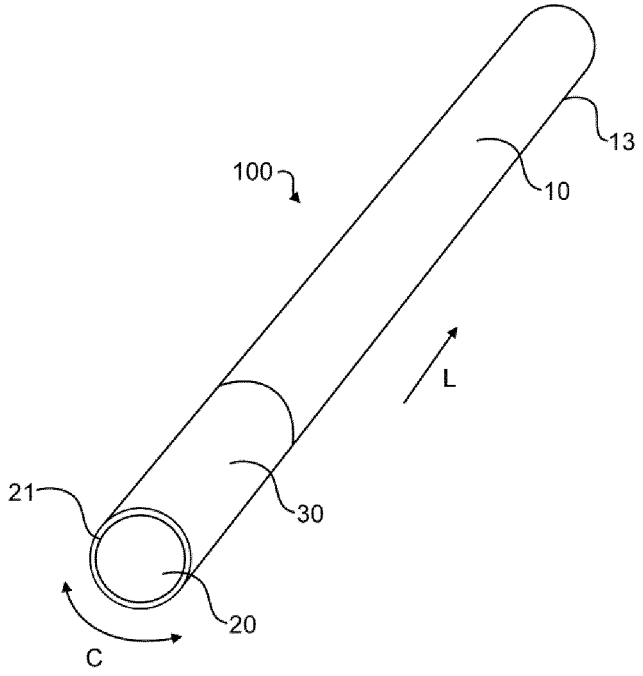
FIG. 1 (A) illustrates a schematic perspective view of an elongated smoking article and (B) illustrates a schematic cross section side view of an elongated smoking article.
Figure 1:
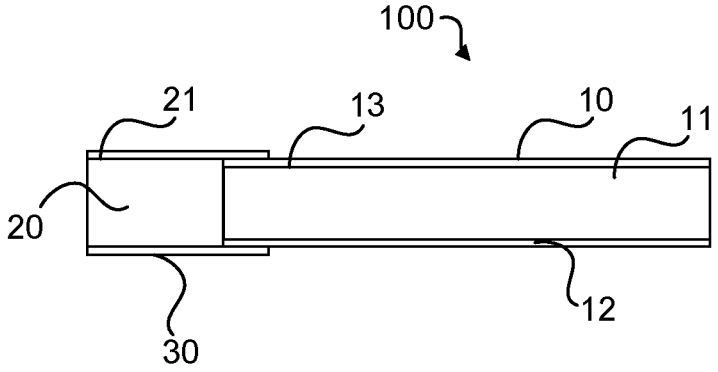

With reference to FIG. 1, a filter cigarette is shown as an example of an elongated smoking article 100 in (A) a schematic perspective view of an elongated smoking article and (B) a schematic cross section side view. The filter cigarette 100 includes a cylindrical rod of combustible material 11 the cylindrical surface of which is surrounded by a wrapping paper 12. The wrapping paper 12 typically incorporates a fibrous material, such as a cellulosic material, e.g. a lignocellulosic material. Exemplary cellulosic materials include flax fibers, hardwood pulp, softwood pulp, hemp fibers, esparto fibers, kenaf fibers, jute fibers and sisal fibers. Mixtures of two or more types of cellulosic materials can be employed.

The combustible material 11 within the wrapping paper 12 is referred to as smoking body 10 and one base area of the smoking body 10 is open to expose the combustible material 11. At one base area of the smoking body 10 the combustible material 11 can be lightened and at the other base area a filter element 20 is positioned. The filter element 20 may be at least partially formed of a weave, mesh, paper, membrane, and/or other appropriate structure providing the desired diffusivity. Its thickness and density may be determined during manufacture or altered thereafter to provide desired diffusivity.

The filter element 20 and the smoking body 13 are axially aligned in an end-to-end relationship along a longitudinal relationship L of the filter cigarette. The filter element 20 has a generally cylindrical shape with a diameter that is essentially equal to the diameter of the smoking body 10. The base areas of the filter element 20 are open to permit the passage of air and smoke therethrough. One of these base areas contacts the smoking body 10 and the other base area forms a mouthpiece for a user. The filter element 20 includes a filter material, such as e.g. plasticized cellulose acetate or a biodegradable material, which is configured to reduce substances in combustion gases that are drawn by a smoker from the burning smoking body 10 through the mouthpiece base area of the filter element 20.

The filter element 20 is fixed to the smoking body 10 via a tipping paper 30 that is circumscribing both, the filter element 20 and the smoking body 10. The tipping paper 30 is wrapped over the filter element 20 and the smoking body 10 along the longitudinal direction L and is attached by an adhesive to an external surface 13 of the smoking body 10 and to an external surface 21 of the filter element 20. Thus, the tipping paper 30 provides a force closure between smoking body 10 and filter element 20 via an indirect adhesive bond using a suitable adhesive, such as e.g., a water-based adhesive of the type traditionally employed by cigarette manufacturers for application of tipping paper during filtered cigarette manufacture. In other words, the tipping paper 30 extends around the longitudinally extending periphery of substantially the entire length of the filter element 20 and around a portion of the longitudinally extending periphery of the wrapping paper 12 of the combustible material 11 in a region of the smoking body 10 immediately adjacent to the filter element 20.

Figure 2:
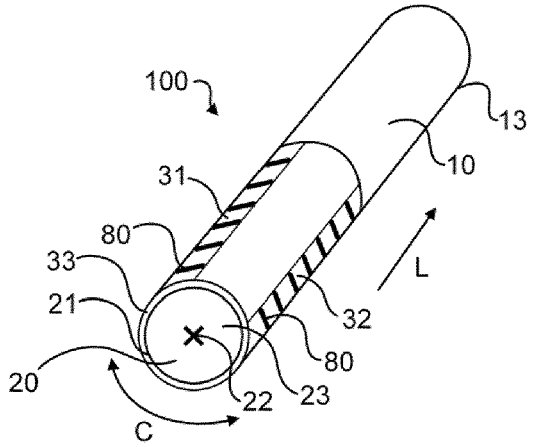
FIG. 2 illustrates a filter element of an elongated smoking article according to a first embodiment.

FIG. 2 illustrates a schematic perspective view of a filter element 20 of an elongated smoking article 10 according to a first embodiment of the invention. Therein the filter element 20 has a circular cross section 23 and the tipping paper 30 has a circular ring cross section 33. A flavoring 80 is disposed in and/or on a first section 31 of the tipping paper 30 and the same flavoring 80 is disposed in and on a second section 32 of the tipping paper 30. Further, no flavoring 80 is disposed in or on the remaining tipping paper 30 outside these first and second sections 31, 32. The first section 31 is disposed on a first circle sector of the filter element 20 and the second section 32 is disposed on a second circle sector of the filter element 20, wherein the second circle sector and thus the second section 32 is opposite to the first section 31. In more detail, the second circle sector and the second section 32 are point reflections of the first circle sector and the first section 32, respectively, with respect to a rotational symmetry axis 22 of the filter element 20. Further, the first circle sector and the second circle sector have similar central angles of about 90 degrees.

Figure 3:
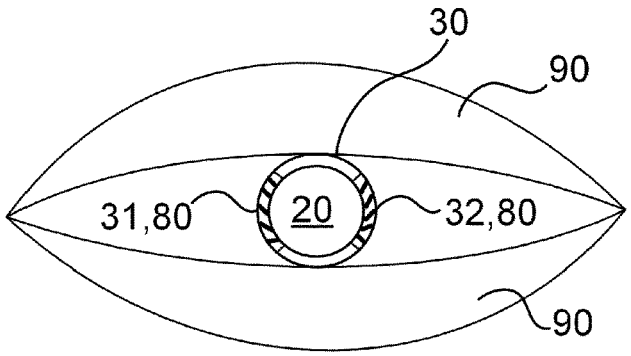
FIG. 3 illustrates the interaction of the filter element of the first embodiment with the lips of a smoker in (A) a first configuration and (B) a second configuration.
Figure 3:
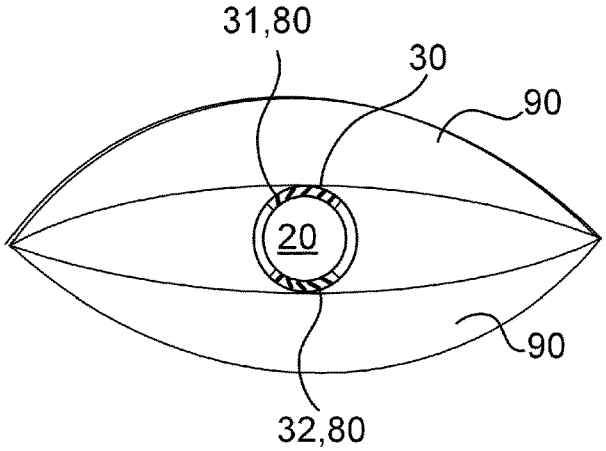

In FIG. 3 the interaction of the filter element 20 of the filter cigarette 100 according to the first embodiment as shown in FIG. 2 with the lips of a smoker 90 is shown in (A) a first configuration and (B) a second configuration. In the first configuration (A), the first section 31 and the opposite second section 32, both containing the flavoring 80, are aligned with the horizontal direction. As the contact between the lips 90 of a consumer and the filter element 20 occurs predominantly at an upper end of the filter element, i.e. with the upper lip 90, and a lower end of the filter element 20, i.e. with the lower lip 90, the first and second section 31, 32 does thus not contact the lips 90 of the consumer. Thus, the consumer experiences no gustatory or olfactory sensation based on the flavoring 80. However, by rotating the filter element 20 about 90 degrees, the first section 31 is brought in contact with the upper lip 90 and the second section 32 is brought in contact with the lower lip 90 as illustrated in the configuration of FIG. 3 (B). Hence, the flavoring 80 disposed in the first section 31 and the second section 32 is brought into contact with the lips 90 of the consumer and the consumer thus experiences a gustatory sensation based on the flavoring. By rotating the filter cigarette 100, the consumer can thus decide on whether or not he or she wants to experience the sensation of the flavoring 80.

Figure 4:
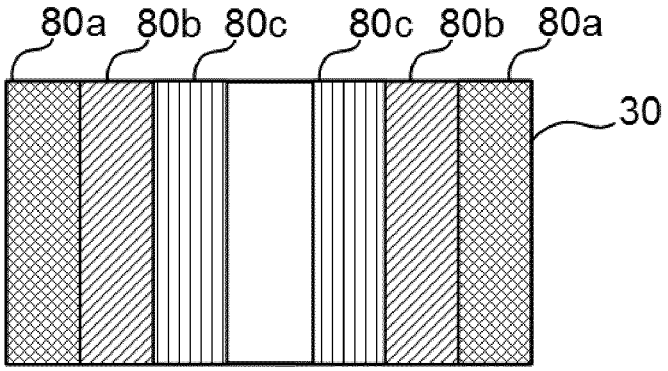
FIG. 4 schematically illustrates the circumference of tipping papers of an elongated smoking articles according to (A) a second embodiment, (B) a third embodiment and (C) a fourth embodiment.
Figure 4:
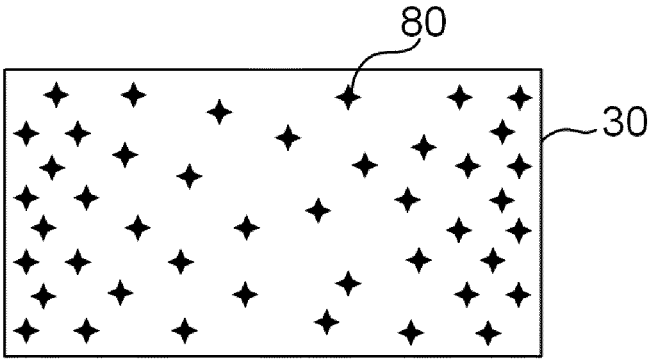
Figure 4:
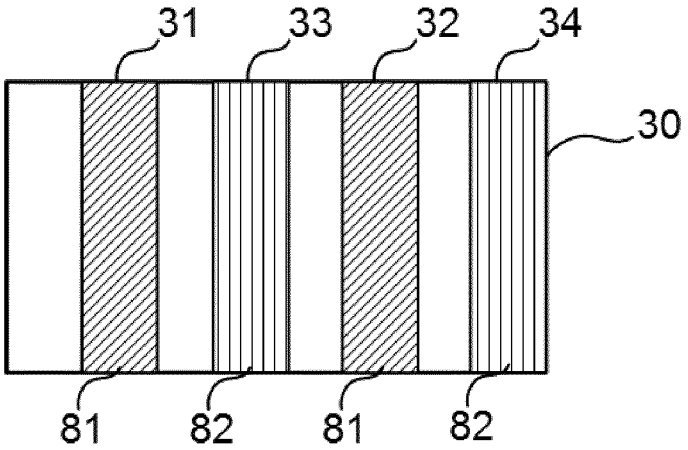

Further embodiments of the tipping papers 30 of elongated smoking articles 100 according to embodiments of the invention are illustrated in FIG. 4. Therein, a second embodiment is illustrated in FIG. 4 (A), which illustrates a front view of a cylindrical filter element 20. Therein, at both outer edges of the filter element 20 a first concentration of flavoring 80*a* is disposed on the tipping paper 30 circumscribing the filter element 20. Towards the front edge of the filter element 20, a second concentration of flavoring 80*b* is disposed adjacent to the first concentration 80*a* of flavoring and a third concentration of flavoring 80*c* is disposed adjacent to the second concentration of flavoring 80*b*. Therein, the first concentration 80*a* is higher than the second concentration 80*b* that is higher than the third concentration 80*c*. In other words, in the second embodiment of the tipping paper 30, a flavoring is provided in two sections comparable to those illustrated in FIGS. 2 and 3, wherein the concentration of the flavoring fades towards the outskirts of these sections. Hence, additionally to deciding whether or not the consumer wants to experience the flavoring 80 at all, the consumer can further set the strength of the flavoring that he or she experiences by rotating the filter 20.

A third embodiment is illustrated in FIG. 4 (B), which again illustrates a front view of a cylindrical filter element 20. Therein, a flavoring 80 is disposed on the tipping paper 30 circumscribing the filter element 20 with a continuous concentration gradient. Therein, a concentration of the flavoring 80 is highest at the both outer edges of the filter element 20 and fades continuously towards the front edge of the filter element 20. Hence, FIG. 4 (B) provides the same effect as the embodiment of FIG. 4 (A) but with a continuous gradient of flavoring 80 instead of the three-fold discrete gradient of flavoring 80. Hence, a user can set even more freely the amount of experienced flavoring by rotating the filter element 20.

A fourth embodiment is illustrated in FIG. 4 (C), which does not illustrate a front view of a cylindrical filter element 20 but instead illustrates a tipping paper 30 unwound from a filter element 20. Therein, a first flavoring 81 is disposed in a first section 31 and a second section 32 of the tipping paper 30 and a second flavoring 82 is disposed in a third section 33 and a fourth section 34 of the tipping paper 30. Further, a leftmost and void section of the tipping paper is configured to be adhesively attached to the backside of the fourth section 34 for circumscribing the tipping paper 30 around a cylindrical filter element 20. Then, if the tipping paper 30 is adhesively circumscribed around the filter element 20, the first section 31 is disposed on a first circle sector of the filter element 20 and the second section 32 is disposed on a second circle sector of the filter element 20 opposite the first circle sector. Further, the third section 33 is disposed on a third circle sector of the filter element 20 in between the first and second circle sector in the circumferential direction C of the filter element 20 and the fourth section 34 is disposed on a fourth circle sector of the filter element 20 opposite the third circle sector. Thus, in comparison to the configurations shown in FIG. 3, a consumer can align the first and second section 31, 32 with a vertical direction such that the first flavoring 81 is in contact with the consumer's lips 90. Alternatively, the consumer can align the third and fourth section 33, 34 with a vertical direction such that the second flavoring 82 is in contact with the consumer's lips 90. Thus, by rotating the filter cigarette 100 the user can switch between the sensation of first and second flavoring 81, 82.

Figure 5:
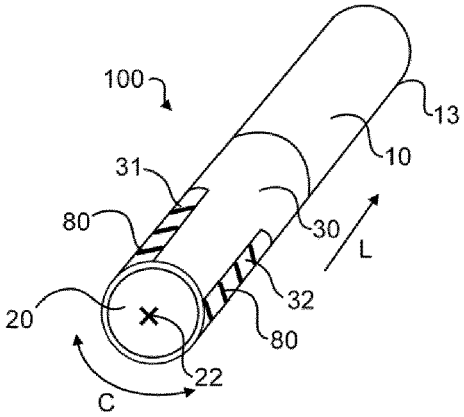
FIG. 5 illustrates filter elements of elongated smoking articles according to (A) a fifth embodiment, (B) a sixth embodiment, and (C) a seventh embodiment.
Figure 5:
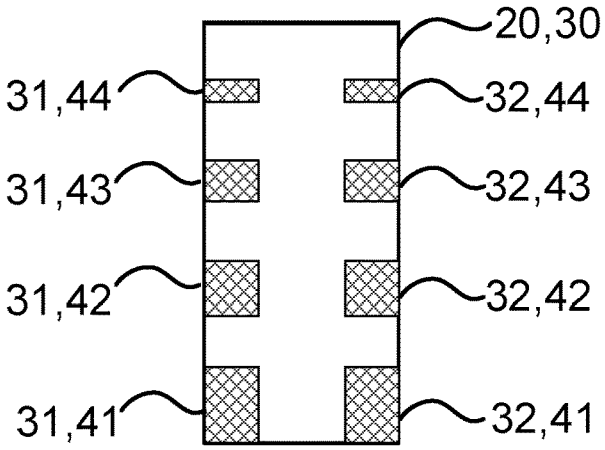
Figure 5:
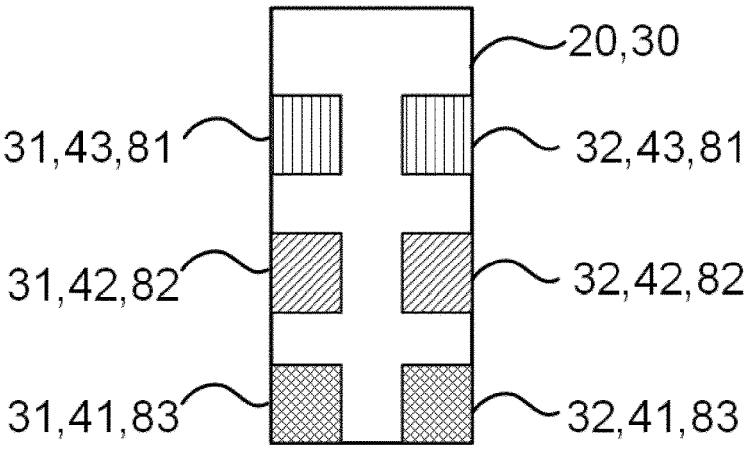

FIG. 5 illustrates filter elements 20 with a circumscribing tipping paper 30 of the invention according to a fifth embodiment (A), a sixth embodiment (B), and a seventh embodiment (C). These embodiments have in common that a distribution of a flavoring 80 further varies in a longitudinal direction L of the tipping paper 30. Therein the amount and/or the type of flavoring 80 that is contacting a smoker's lips 90 further depends on translational state of the elongated smoking article 100 with respect to the longitudinal direction L.

In the filter element 20 of the fifth embodiment of FIG. 5 (A), the first and second sections 31, 32 do not extend across the whole length of the filter element 20 but extend from the mouthpiece end of the filter element 20 along half the length of the filter element 20. Thus, a user can decide whether or not he or she wants to experience the sensation of the flavoring 80 by rotating the filter element 20, if the half of the filter element 20 proximal to its mouthpiece end is in contact with the lips 90 of the user as described with respect to FIG. 3. However, by further inserting the filter element 20 into the mouth of the user, such that the half of the filter element 20 distal to its mouthpiece end is in contact with the lips 90 of the user, the user can decide to not experience the flavoring 80 irrespective of the rotational state of the filter element 20. Hence, the freedom of choice is further increased.

In the filter element 20 of the sixth embodiment of FIG. 5 (B), a flavoring (crosshatching) is disposed in a first section 31 of the tipping paper 30, i.e. a first angular section 31, as described above and a second section 32 of the tipping paper 30, i.e. a second angular section 32, as described above. Further, the flavoring is disposed in four cylindrical sections 41, 42, 43, 44 of the tipping paper 30. By combining the circumferentially varying distribution of flavoring based on the first and second sections 31, 32 with the longitudinally varying distribution of flavoring based on the first to fourth cylindrical sections 41, 42, 43, 44 a total of eight sections is generated that provides a distribution of flavoring that varies in the longitudinal and the circumferential direction. Thus, a user can adjust whether or not he wants to experience the flavoring by rotating the filter element 20 around a rotational symmetry axis of the filter element 20 and can further adjust the intensity of the experienced flavoring by translating the filter element 20 along the longitudinal direction of the filter 20, wherein the intensity decreases with decreasing width of the cylindrical sections 41 to 44.

In the filter element 20 of the seventh embodiment of FIG. 5 (C), a first flavoring 81 is disposed in a first section 31 of the tipping paper 30, i.e. a first angular section 31, as described above and a second section 32 of the tipping paper 30, i.e. a second angular section 32, as described above. Further, the first flavoring 81 is disposed in a third cylindrical section 43 of the tipping paper 30. A second flavoring 82 is disposed in the first angular section 31 and the second angular section 32 as well as in a second cylindrical section 42 of the tipping paper 30. Finally, a third flavoring 83 is disposed in the first angular section 31 and the second angular section 32 as well as in a third cylindrical section 43 of the tipping paper 30. By combining the circumferentially varying distribution of flavorings 81, 82, 83 based on the first and second sections 31, 32 with the longitudinally varying types of flavorings 81, 82, 83 based on the first to third cylindrical sections 41, 42, 43 a total of six sections is generated that provides a distribution of flavorings 81, 82, 83 that varies in the longitudinal and the circumferential direction. Thus, a user can adjust whether or not he wants to experience any flavoring 81, 82, 83 by rotating the filter element 20 around a rotational symmetry axis of the filter element 20 and can further adjust the type of the experienced flavoring 81, 82, 83 by translating the filter element 20 along the longitudinal direction of the filter element 20. Hence, the user's freedom of choice is further increased.

REFERENCE SIGNS

10 cylindrical smoking body
11 combustible material
12 wrapping paper
13 external surface of the smoking body
20 filter element
21 external surface of the filter element
22 rotational symmetry axis of the filter element
23 cross section of the filter element
30 tipping paper
31 first section of the tipping paper
32 second section of the tipping paper
33 third section of the tipping paper
35 fourth section of the tipping paper
35 cross section of the tipping paper
41-44 first to fourth cylindrical section
80 flavoring
80*a* first concentration of flavoring
80*b* second concentration of flavoring
80*c* third concentration of flavoring
81 first flavoring
82 second flavoring
83 third flavoring
90 smoker's lips
100 elongated smoking article
L longitudinal direction
C circumferential direction

The invention claimed is:

1. Elongated smoking article extending in a longitudinal direction, comprising:

a cylindrical smoking body with a combustible material surrounded by a wrapping paper;

a filter element configured to reduce substances from combustion gases drawn through the filter element from the burning smoking body; and a tipping paper circumscribing the smoking body and the filter element and being attached to external surfaces of the smoking body and the filter element, wherein a flavoring is disposed in or on the tipping paper with a distribution that varies in a circumferential direction of the tipping paper, wherein the amount and/or type of flavoring contacting a smoker's lips depends on a rotational state of the elongated smoking article with respect to the circumferential direction, wherein the filter element has a circular cross section and the tipping paper has a circular ring cross section, wherein the flavoring is disposed within a first section of the tipping paper, the first section of the tipping paper being disposed on a first circle sector of the filter element extending in the longitudinal direction of the elongated smoking article, and wherein, in a first circular ring cross section of the tipping paper, the flavoring within the first section of the tipping paper extends circumferentially between a first pair of opposite ends wherein, in a second circular ring cross section of the tipping paper, the flavoring within the first section of the tipping paper extends circumferentially between a second pair of opposite ends, the second pair of opposite ends each being aligned, along the longitudinal direction, with the flavoring within the first section in the first circular ring cross section.

2. Elongated smoking article according to claim 1, wherein the flavoring is further disposed within a second section of the tipping paper, the second section of the tipping paper being opposite to the first section.

3. Elongated smoking article according to claim 2, wherein the second section is a point reflection of the first section with respect to a rotational symmetry axis of the filter element.

4. Elongated smoking article extending in a longitudinal direction, comprising:

a cylindrical smoking body with a combustible material surrounded by a wrapping paper;

a filter element configured to reduce substances from combustion gases drawn through the filter element from the burning smoking body; and a tipping paper circumscribing the smoking body and the filter element and being attached to external surfaces of the smoking body and the filter element, wherein a flavoring is disposed in or on the tipping paper with a distribution that varies in a circumferential direction of the tipping paper, wherein the amount and/or type of flavoring contacting a smoker's lips depends on a rotational state of the elongated smoking article with respect to the circumferential direction, wherein the filter element has a circular cross section and the tipping paper has a circular ring cross section, wherein the flavoring is disposed within a first section of the tipping paper, the first section of the tipping paper being disposed on a first circle sector of the filter element extending in the longitudinal direction of the elongated smoking article, and wherein the first circle sector has a central angle of 90 degrees or less.

5. Elongated smoking article according to claim 2, wherein a first flavoring is disposed in the first section and the second section, and a second flavoring is disposed within a third section and a fourth section of the tipping paper, the third section being disposed between the first section and the second section and the fourth section being opposite the third section.

6. Elongated smoking article according to claim 1, wherein a first flavoring is disposed within the first section and a second flavoring is disposed within a second section of the tipping paper, the second section being rotated from the first section about an angle of less than 180 degrees.

7. Elongated smoking article according to claim 1, wherein the remaining tipping paper does not comprise any flavoring.

8. Elongated smoking article according to claim 7, wherein a concentration of flavoring changes continuously along the circumferential direction of the tipping paper.

9. Elongated smoking article according to claim 8, wherein the distribution of the flavoring further varies in a longitudinal direction of the tipping paper, and wherein the amount and/or type of flavoring contacting a smoker's lips further depends on translational state of the elongated smoking article with respect to the longitudinal direction.

10. Elongated smoking article according to claim 9, wherein the flavoring is disposed in and/or on the tipping paper by applying a solution of flavoring to the tipping paper.

11. Elongated smoking article according to claim 10, wherein the flavoring is disposed on the tipping paper by applying at least one layer of flavoring material on the tipping paper.

12. Tipping paper for an elongated smoking article according to claim 1.

13. Elongated smoking article according to claim 1, wherein a concentration of flavoring changes continuously along the circumferential direction of the tipping paper.

14. Elongated smoking article according to claim 1, wherein the distribution of the flavoring further varies in a longitudinal direction of the tipping paper, and wherein the amount and/or type of flavoring contacting a smoker's lips further depends on translational state of the elongated smoking article with respect to the longitudinal direction.

15. Elongated smoking article according to claim 1, wherein the flavoring is disposed in and/or on the tipping paper by applying a solution of flavoring to the tipping paper.

16. Elongated smoking article according to claim 1, wherein the flavoring is disposed on the tipping paper by applying at least one layer of flavoring material on the tipping paper.

17. Elongated smoking article according to claim 1, wherein, in a third circular ring cross section of the tipping paper, the flavoring within the first section of the tipping paper extends circumferentially between a third pair of opposite ends, the third pair of opposite ends each being aligned, along the longitudinal direction, with each of the flavoring within the first section in the first circular ring cross section and the flavoring within the first section in the second circular ring cross section.

18. Elongated smoking article according to claim 1, wherein the second pair of opposite ends are respectively aligned, along the longitudinal direction, with the first pair of opposite ends.

19. Elongated smoking article according to claim 1, wherein the first circle sector extends longitudinally between a first end proximal to a mouthpiece end of the filter and a second end distal to the mouthpiece end, the first circle sector having two sides that extend between the first and second ends of the first circle sector and that are parallel to the longitudinal direction.

20. Elongated smoking article according to claim 1, wherein the first circle sector extends longitudinally between a first end proximal to a mouthpiece end of the filter and a second end distal to the mouthpiece end, a longitudinal length of the first circle sector between the first and second ends being at least half of a longitudinal length of the filter element.

* * * * *